US010357787B2

(12) United States Patent
Thorwid et al.

(10) Patent No.: US 10,357,787 B2
(45) Date of Patent: Jul. 23, 2019

(54) CENTRIFUGAL SEPARATOR HAVING ENERGY CONSUMPTION REDUCING DEVICES

(75) Inventors: Peter Thorwid, Sundbyberg (SE); Roland Isaksson, Grödinge (SE); Peter Hagqvist, Stockholm (SE); Carl Häggmark, Täby (SE); Lars Hillström, Uppsala (SE)

(73) Assignee: Alfa Laval Corporate AB, Lund (SE)

( * ) Notice: Subject to any disclaimer, the term of this patent is extended or adjusted under 35 U.S.C. 154(b) by 1768 days.

(21) Appl. No.: 13/254,297

(22) PCT Filed: Mar. 5, 2010

(86) PCT No.: PCT/SE2010/050251

§ 371 (c)(1),
(2), (4) Date: Nov. 4, 2011

(87) PCT Pub. No.: WO2010/101524

PCT Pub. Date: Sep. 10, 2010

(65) Prior Publication Data

US 2012/0040816 A1 Feb. 16, 2012

(30) Foreign Application Priority Data

Mar. 6, 2009 (SE) ..... 0950131

(51) Int. Cl.
*B04B 11/02* (2006.01)
*B04B 7/02* (2006.01)
(Continued)

(52) U.S. Cl.
CPC ..... *B04B 11/02* (2013.01); *B04B 7/02* (2013.01); *B04B 15/02* (2013.01); *B04B 15/08* (2013.01)

(58) Field of Classification Search
CPC ..... B04B 15/02; B04B 15/08; B04B 11/02; B04B 7/02; B01B 1/10; B01B 1/12; B01B 1/16; B01B 1/18
(Continued)

(56) References Cited

U.S. PATENT DOCUMENTS 2,064,798 A 12/1936 Jones
3,001,293 A * 9/1961 Wendt ..... C01B 33/186 159/DIG. 25
(Continued)

FOREIGN PATENT DOCUMENTS

DE 2214487 10/1972
DE 2508503 A1 9/1976
(Continued)

OTHER PUBLICATIONS

International Search Report; International Application No. PCT/SE2010/050251; dated Aug. 17, 2010.
(Continued)

*Primary Examiner* — Marc C Howell
(74) *Attorney, Agent, or Firm* — Murtha Cullina LLP

(57) ABSTRACT

The invention relates to a centrifugal separator comprising a casing which delimits and seals off a space in which a rotor is arranged. The rotor forms a separation space which is sealed or isolated from the space, and in which separation space centrifugal separation of a higher density and a lower density component from a fluid takes place. An inlet extends into the rotor for introducing fluid to the separation space, and a first outlet extends from the rotor for discharge of a component separated from the fluid. The space is connected to a pump device which is arranged to remove gas, thereby maintaining negative pressure in said space. The rotor comprises at least one second outlet extending from the separation space to the space for discharge of at least one
(Continued)

higher density component separated from the fluid. The invention also relates to a method in such a centrifugal separator.

20 Claims, 3 Drawing Sheets

(51) Int. Cl.
*B04B 15/02* (2006.01)
*B04B 15/08* (2006.01)

(58) Field of Classification Search
USPC ..... 494/14, 61, 68–70, 48, 60
See application file for complete search history.

(56) References Cited

U.S. PATENT DOCUMENTS

| | | | | |
|---|---|---|---|---|
| 3,007,629 | A | 11/1961 | Boyland | |
| 3,166,503 | A * | 1/1965 | Thylefors | 494/41 |
| 3,239,137 | A * | 3/1966 | Wenger | B01D 37/04 494/2 |
| 3,300,129 | A | 1/1967 | Brunati | |
| 3,327,938 | A | 6/1967 | Stallmann | |
| 3,606,143 | A | 9/1971 | Stallmann | |
| 3,777,972 | A | 12/1973 | Kjellgren | |
| 3,822,823 | A | 7/1974 | Wutz | |
| 3,924,804 | A | 12/1975 | Niemeyer | |
| 3,928,003 | A * | 12/1975 | Fryar | B01D 19/0052 494/37 |
| 3,955,757 | A | 5/1976 | Lowry | |
| 4,017,023 | A | 4/1977 | Hemfort | |
| 4,030,897 | A | 6/1977 | Pelzer et al. | |
| 4,356,932 | A | 11/1982 | Wahlstrom et al. | |
| 4,614,598 | A | 9/1986 | Zettier et al. | |
| 4,941,866 | A | 7/1990 | Gorodissky et al. | |
| 6,390,964 | B1 * | 5/2002 | MacKel | 494/14 |
| 6,530,871 | B1 | 3/2003 | Mackel et al. | |
| 7,081,082 | B2 | 7/2006 | Scholz et al. | |
| 7,204,795 | B2 * | 4/2007 | Himmen et al. | 494/14 |
| 2005/0006319 | A1 | 1/2005 | Scholz et al. | |
| 2005/0272587 | A1 * | 12/2005 | Niinai | 494/12 |

FOREIGN PATENT DOCUMENTS

| | | | |
|---|---|---|---|
| DE | 3019737 | A1 | 12/1981 |
| DE | 3924372 | C1 | 11/1990 |
| DK | 75995 | | 6/1953 |
| EP | 0016572 | A1 | 1/1980 |
| EP | 0290606 | A1 | 11/1988 |
| EP | 0411261 | A1 | 2/1991 |
| EP | 1090687 | A1 | 4/2001 |
| FR | 408996 | A | 4/1910 |
| GB | 647786 | | 12/1950 |
| GB | 870862 | | 6/1961 |
| GB | 983689 | | 2/1965 |
| KR | 75995 | | 6/1963 |
| RU | 2240183 | C2 | 11/2004 |
| WO | 0220119 | A1 | 3/2002 |
| WO | 03013686 | A1 | 2/2003 |
| WO | 2008/013495 | A1 | 1/2008 |

OTHER PUBLICATIONS

KIPO Notice of Preliminary Rejection for corresponding Korean Patent Application No. 10-2011-7020679 dated Jun. 28, 2013.
International Type Search Report for corresponding SE Patent Application No. SE0900052 dated Aug. 26, 2009.
Communication of a Notice of Opposition from corresponding EP2403650 dated Sep. 22, 2017.
Lehmann et al., Processing Lines for the Production of Soft Cheese, Advertising/Communication Westfalia Separator AG, 1991, 52 pages, Germany.
KDC 30 Nozzle Separator in steam sterilized design, Wesffalia Separator AG,15 pages, Germany.
Julian C. Smith, "Applications, Special equipment and materials are increasing the range of centrifugal separators. Emphasis is on unusual applications," Centrifugation Equipment, vol. 53, No. 6, pp. 439-444.

* cited by examiner

CENTRIFUGAL SEPARATOR HAVING ENERGY CONSUMPTION REDUCING DEVICES

FIELD OF THE INVENTION

The present invention relates to a centrifugal separator comprising a rotor and to a method in such a centrifugal separator.

BACKGROUND OF THE INVENTION

Operating a centrifugal separator involves consumption of energy, part of which is lost in the form of aerodynamic losses at the contact between the rotating parts, e.g. the rotor, and surrounding gas. These losses may thus cause unnecessarily high energy consumption of the centrifugal separator. The losses also contribute to warming of the rotating parts and of adjacent parts and material, e.g. said fluid for centrifugal separation. In many cases this warming is undesirable, particularly where fluids which are sensitive to thermal action are to be separated. A further problem with the warming is that the heat generated may have to be disposed of, which in many cases entails the centrifugal separator having to be provided with a cooling device, e.g. such a separator may be provided with a water-cooled casing.

DK 75995 C describes clarification of beer in a centrifugal separator in which the separation takes place in a separator bowl enclosed in an evacuated space. The object is to reduce the warming of the beer passing through the separator and thereby improve the clarification. The centrifugal separator described has a rotor of so-called solid wall type, which does not make it possible to discharge any separated components from the beer via outlets at the periphery of the rotor.

RU 2240183 C2 describes a centrifugal machine for cleaning of liquids which comprises a container of water in a space round the rotor, which water is caused to vaporise and form water vapour in the space round the rotor in order to reduce the aerodynamic losses during rotation. A wall is arranged to prevent separated material from moving out into the space round the rotor.

SUMMARY OF THE INVENTION

An object of the present invention is to reduce the abovementioned shortcomings. A further object of the present invention is to obtain a centrifugal separator with low energy consumption, to reduce the warming of the rotating parts of a centrifugal separator, to reduce the noise from a centrifugal separator and to obtain a discharging separator with an improved hygienic environment around the rotor.

Thus the present invention relates to a centrifugal separator comprising a casing which delimits a space which is sealed relative to the surroundings of the casing and in which space a rotor is arranged for rotation. The rotor forms within itself a separation space which is sealed or isolated from the space round the rotor and in which separation space centrifugal separation of at least one higher density component and at least one lower density component from a fluid takes place during operation. The fluid may be liquid based, and the components may be in liquid and/or particulate form. At least one inlet extends into the rotor for introducing said fluid to the separation space for centrifugal separation, and at least one first outlet extends from the rotor for discharge of at least one component separated from the fluid during operation. The space round the rotor, in which space the rotor is arranged for rotation, is further connected to a pump device. The separator may alternatively be adapted and provide connections for connecting a pump device to said space. The pump device is arranged to remove gas from the space during operation, thereby maintaining negative pressure in said space. The pump device may take the form of a pump, a vacuum source or a negative pressure source. The rotor further comprises at least one second outlet, called sludge outlet, for discharge of at least one higher density component separated from the fluid during operation, which component hereinafter is called the sludge phase. The sludge phase may comprise sludge particles and/or at least one fluid component with a higher density, or heavy phase. Particles may be in solid and/or liquid form. Said second outlet extends from a portion of the separation space, which may be a radially outer portion of the separation space, to the space round the rotor and may lead to the outer periphery of the rotor. Thus, the present invention reduces friction losses during operation of the centrifugal separator. The warming of the rotating parts in connection to the space round the rotor decreases, making it possible to separate fluids which are sensitive to thermal action. The heat transfer in the space round the rotor also decreases, thereby further reducing the need for cooling of the outer parts of the centrifugal separator, e.g. its casing. Further consequences are a relatively cool environment in the space outside the rotor, reducing the risk of discharged sludge phase adhering to surfaces in the space, and a tranquil environment with reduced swirling currents or vortical flow carrying aerosols in the space. The result is an improved hygienic environment in the space outside the rotor, with less risk of deposits, coatings or scaling, thereby making it easier to keep the space clean. Moreover, the sludge phase, after discharge via said sludge outlet, will contain a smaller amount of gas than after similar discharge via a sludge outlet at atmospheric pressure. Where there is subsequent handling of the sludge phase at atmospheric pressure, this means a smaller volume of sludge to be handled. A further consequence of the negative pressure in the space is that noise generation and noise propagation from the rotating parts decrease, thereby maintaining a reduced noise level and a less unpleasant noise characteristic from the centrifugal separator. In particular, problems with noise generated at sludge outlets during rotation of the rotor decrease, allowing simpler configuration of the sludge outlets.

According to an embodiment of the invention, the separation space comprises a stack of frusto-conical separation discs, providing effective separation of the components of the fluid during operation.

According to another embodiment of the invention, said at least one second outlet, or sludge outlet, is arranged for intermittent discharge of the sludge phase during operation. The at least one second outlet may comprise a set of outlets distributed around the circumference of the rotor. As an alternative, said sludge outlet may be arranged for continuous discharge of the sludge phase during operation.

According to another embodiment of the invention, the centrifugal separator comprises a device for supplying a medium to said space, which medium is brought into heat-transferring contact with the rotor in order to regulate the temperature of the rotor. Thus it possible to limit the warming of the rotor and further to regulate and control the temperature of centrifugally separated components. The device for supplying a medium to said space may comprise a reservoir or an inlet line for the medium.

According to another embodiment of the invention, said medium comprises a liquid which in said heat-transferring contact is at least partly caused to evaporate and form a gas medium in the space round the rotor, which gas medium carries along the vaporisation heat which is consumed during vaporisation. As the pump device is arranged to remove gas from the space, part of this vaporisation heat is conveyed from the space. The fact that the space is maintained at negative pressure facilitates the vaporisation of the liquid and results in effective transfer of heat from the rotor even at moderate temperatures. The medium may comprise water or an alcohol, e.g. ethanol. As the environment in the space round the rotor is kept damp, the risk of deposits and coatings on surfaces adjacent to the space decreases, thereby maintaining an improved hygienic environment. Said medium may also comprise a gas medium which is warmed by contact with the rotor and similarly carries heat away from the rotor via said pump device.

According to another embodiment of the invention, said gas medium has a density lower than the density of air and/or a viscosity lower than the viscosity of air under similar physical conditions. If the gas remaining in the space round the rotor in the evacuated or pumped-down state has a density lower than the density of air and/or a viscosity lower than the viscosity of air, at the same pressure and temperature, a further reduced aerodynamic resistance to rotation of the rotor may be obtained and hence reduced energy consumption and reduced friction-based warming effects. The medium may comprise water, or the gas medium may comprise water vapour, which in its gaseous form has a lower density than air and therefore causes lower aerodynamic resistance. The gas medium may further comprise at least one out of nitrogen gas, carbon monoxide and helium.

According to another embodiment of the invention, said medium is sprayed towards the rotor, preferably towards its outer surface. This results in heat-transferring contact between the medium and the rotor. As an alternative, said medium is finely divided or atomized in the space and is brought into heat-transferring contact with the rotor by currents and turbulence in the space round the rotor.

According to another embodiment of the invention, a flow of medium is driven into said space round the rotor by pressure difference between a container for medium and the space, which flow is controlled by a valve. During operation, the valve may be adapted to adjusting the flow of medium into the space on the basis of some operating condition of the centrifugal separator, e.g. the temperature of some portion of the rotor or the temperature of the fluid for centrifugal separation. The pressure difference may be based on the difference in pressure between the space round the rotor and the surrounding of the centrifugal separator, thus providing a simple and cost-effective way of maintaining and regulating the flow.

According to another embodiment of the invention, the centrifugal separator is provided with a cold surface in said space for condensing said gas medium to a condensate. The cold surface may preferably be at a temperature lower than the temperature of some portion of the rotor and may be provided with cooling loops for cooling or removal of heat. The negative pressure in the space round the rotor provides conditions for good heat transfer between the rotor and the cold surface.

According to another embodiment of the invention, the condensate is brought into contact with the rotor, e.g. against its outer surface, thereby maintaining a circulation of said medium in the space and at the same time a transfer of heat from the rotor to the cold surface. The cold surface may be so situated that the condensate is brought back into contact with the rotor by gravitation or centrifugal force.

According to another embodiment of the invention, the pump device comprises any out of a liquid ring pump, a lamella pump, an ejector pump, a membrane pump, a piston pump, a scroll pump, a screw pump or combinations thereof. The pump device may further be a vacuum source or negative pressure source. A liquid ring pump prefilled with water is suitable for pumping of gas mixed with water. As an alternative, a lamella pump may be used for reaching pressures below the prevailing vapour pressure for water. An ejector pump further makes it possible to use existing liquid flows in the system, e.g. the flow of said fluid for centrifugal separation at an inlet or outlet, as a way of generating said negative pressure.

According to another embodiment of the invention, the pump device may be arranged for removing both gas and liquid material from the space round the rotor, which liquid material may comprise medium supplied to the space, sludge phase discharged to the space from the separation space, condensate, cleaning agents or combinations thereof. The pump device may further be arranged to remove medium, e.g. gas and/or liquid, from the space round the rotor either continuously or intermittently. As an alternative, the pump device may be adapted to being driven by some portion of the centrifugal separator which rotates during operation, e.g. a spindle adapted to supporting the rotor.

According to another embodiment of the invention, the pump device is arranged to remove gas from the space round the rotor, thereby maintaining in the space a negative pressure, i.e. a pressure lower than atmospheric pressure such as a pressure of 1-50 kPa, preferably 2-10 kPa. The pump device may further be arranged to adjust the pressure in the space during operation on the basis of some operating condition of the centrifugal separator. The pressure in the space may be adjusted during operation on the basis of a temperature in the space, e.g. the temperature of a portion of the rotor, in which case the pressure may be adjusted in relation to the vapour pressure of the medium in the space round the rotor at said temperature. The pressure in the space may be kept at or just above said vapour pressure so that remaining gas in the space will be in the form of saturated or almost saturated vapour, e.g. water vapour. The pressure in the space may further be adjusted during operation on the basis of vibrations or resonances in the centrifugal separator, preferable resonances in the space, in the rotor or in parts adjacent to it. Disturbing noise and sounds may thus be prevented. As another alternative, the pressure in the space may be adjusted during operation on the basis of the flow of gas in the space, in which case the turbulence of the gas flow may be controlled in order to provide desirable swirling or vortical flow of gas in the space. An improved hygienic environment may thus be maintained in the space during operation. The pressure in the space and the turbulence of the gas flow may also be adjusted during a cleaning procedure when a cleaning agent, e.g. a liquid or a gas, is introduced into the space, in order to achieve effective cleaning of the space. During such a cleaning procedure the cleaning agent may be provided to the space from the second outlet or sludge outlet.

According to another embodiment of the invention, the casing comprises thermally insulating and/or sound-insulating material. With reduced heat-generating losses within the system, the possibility arises of using thermally insulating material to screen the casing, the rotor and thus the fluid from external temperature action. The casing may also be insulated to minimise noise from the centrifugal separator.

An alternative is to use insulating material which has both thermally insulating and sound-insulating properties.

According to another embodiment of the invention, said space round the rotor is sealed or isolated relative to spaces formed in the rotor which contain at least one component during operation, in addition to the separation space. The space round the rotor may thus further be sealed or isolated from an inlet chamber in the rotor or an outlet chamber in the rotor or both the inlet chamber and the outlet chamber. The inlet chamber is a chamber formed in the rotor, to which the inlet extends. The outlet chamber is a chamber formed in the rotor, from which the first outlet extends. Said sealing may be a mechanical seal, a gas seal, a liquid seal, a labyrinth seal or combinations thereof. Said isolation may further be provided by means of at least one passage which is liquid and/or sludge filled during operation, and which may extend between the space round the rotor to said sealed or isolated spaces and/or chambers. Such a passage may be an inlet, a first and/or second outlet, an inlet and/or outlet chamber, and a passage to the separation space, or combinations thereof. The fluid in said sealed or isolated spaces formed in the rotor may be relatively unaffected by the pressure and/or the gas content in the space round the rotor.

According to another embodiment of the invention, said space is sealed relative to a drive device which is arranged to provide torque to the rotor. The drive device may be arranged to transmit driving torque to the rotor via a spindle adapted to supporting the rotor. The space round the rotor may be air-tightly sealed round the spindle between the rotor and the drive device.

According to another embodiment of the invention, a discharge device is arranged to remove sludge phase from the space round the rotor during operation. The discharge device may also be arranged to remove liquid medium which has been supplied to the space for regulating the temperature of the rotor and other liquids which occur in the space. The discharge device may comprise a check valve function so that negative pressure is maintained upstream of it and so that flow through the discharge device into the space round the rotor is prevented. The discharge device may further be arranged to remove gas from the space round the rotor so that negative pressure is maintained in the space.

According to another embodiment of the invention, the centrifugal separator comprises a vessel between the space round the rotor and the discharge device, which vessel is arranged to gather the sludge phase and other liquids which occur in the space. The gathering vessel may take the form of a cyclone and be arranged to gather and slow down the sludge phase.

The present invention further relates to a method in a centrifugal separator as above, which method comprises the steps of:

- removing gas from the space round the rotor, thereby maintaining negative pressure in said space, and
- discharging from a portion of the separation space round the rotor to the space via said second outlet at least one component separated from the fluid during operation.

According to another embodiment of the invention, the method comprises the step of:

- supplying a medium to said space, which medium is brought into heat-transferring contact with the rotor in order to regulate the temperature of the rotor.

According to another embodiment of the invention, said medium comprises a liquid which in said heat-transferring contact with the rotor is at least partly caused to evaporate and form a gas medium in the space, and in which at least part of said gas medium is removed from the space.

The present invention further relates to the use of a centrifugal separator as above for separating at least two components of a fluid, which fluid or at least one of the components of the fluid is sensitive to thermal action. The present invention further relates to the use of a centrifugal separator as above in a process which comprises centrifugal separation of at least two components of a fluid and in which the results of the process are affected by thermal action during said centrifugal separation.

BRIEF DESCRIPTION OF THE DRAWINGS

Further advantages and objects of the present invention, together with preferred embodiments which exemplify it, are described below in more detail with reference to the attached schematic drawings in which.

DETAILED DESCRIPTION OF EMBODIMENTS OF THE INVENTION

Figure 1:
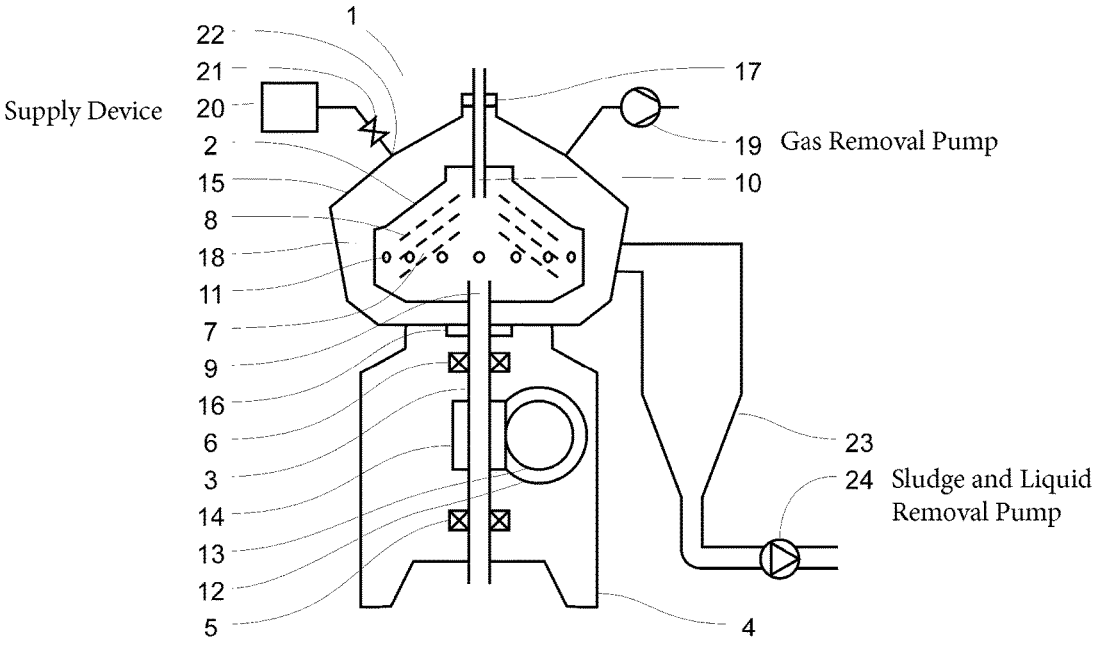
FIG. 1 depicts a centrifugal separator according to an embodiment of the invention.

Mutually similar parts which appear in the various drawings have been given the same reference notations. An example of a centrifugal separator according to the invention is depicted in FIG. 1, which centrifugal separator 1 comprises a rotor 2 arranged for rotation about an axis of rotation by means of a spindle 3. The spindle is supported in the centrifugal separator's frame 4 in a bottom bearing 5 and a top bearing 6. The rotor 2 forms within itself a separation chamber 7 in which centrifugal separation of at least two components of a fluid takes place during operation. The separation space 7 is provided with a stack of frusto-conical separation discs 8 in order to achieve effective separation of said fluid. An inlet 9 for introducing the fluid for centrifugal separation extends into the rotor, providing fluid to the separation space. The inlet 9 extends through the spindle 3, which takes the form of a hollow, tubular member. A first outlet 10 for discharging at least one of the components of the fluid extends from the separation space. The rotor is provided at its outer periphery with a set of second outlets 11 in the form of intermittently openable sludge outlets for discharge of sludge and/or a higher density component in said fluid, or heavy phase, from a radially outer portion of the separation space to the space round the rotor.

Figure 2:
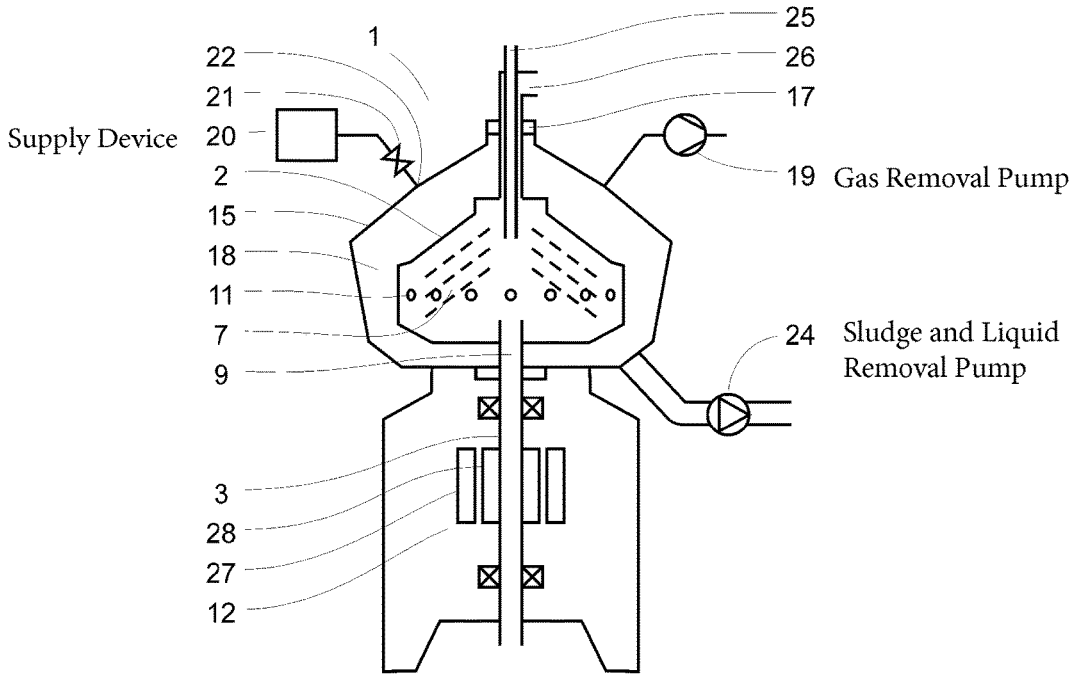
FIG. 2 depicts a centrifugal separator according to another embodiment of the invention.

The centrifugal separator 1 further comprises a drive motor 12 connected to the spindle via a transmission means in the form of a worm gear which comprises a pinion 13 and an element 14 connected to the spindle in order to receive driving torque. The transmission means may alternatively take the form of a propeller shaft, drive belts or the like, and the drive motor may alternatively, as depicted in FIG. 2, be connected directly to the spindle.

FIG. 1 further depicts a casing 15 which encloses the rotor 2 and is sealed round the spindle 3 by a top bearing seal 16 and at the outlet 10 by an outlet seal 17. The casing thus delimits a space 18 which contains the rotor and which is air-tightly sealed relative to the surroundings of the casing. The outlet seal 17 also seals the space 18 relative to the spaces in the rotor which contain at least one component of the fluid for centrifugal separation during operation, e.g. the separation space 7.

The centrifugal separator is further provided with a pump device 19 for removal of gas from the space 18 round the rotor, which pump device takes the form of a water-filled liquid ring pump or, as an alternative, a lamella pump. The separator is further provided with a device 20 for supply of a liquid to said space, in the form of a reservoir or inlet line for supply of a liquid at a pressure higher than the operating pressure in the space 18. The supply device 20 is provided with a valve 21 for regulating a liquid flow to a nozzle 22 in connection to said space 18.

The centrifugal separator further comprises a vessel 23 in the form of a cyclone connected to the space 18 and adapted to gathering sludge and liquid from the sludge outlet 11. The gathering vessel is further connected to a discharge device 24 in the form of a sludge pump for discharge of sludge and liquid present in the gathering vessel. The sludge pump is provided with a check valve function which prevents flow into the vessel 23 via the sludge pump.

During operation of the separator in FIG. 1, the rotor 2 is caused to rotate by torque transmitted from the drive motor 12 to the spindle 3 via the worm gear 13 and 14. Gas is pumped out of the space 18 round the rotor by the vacuum pump 19, thereby maintaining in the space a pressure of 1-50 kPa, preferably 2-10 kPa. Via the inlet 9, a fluid at the temperature $T_0$ is brought into the separation space 7 and between the conical separation discs 8 fitted in the separation space. Heavier components in the fluid, e.g. sludge particles and/or heavy phase, move radially outwards between the separation discs and accumulate within the sludge phase outlets 11. Sludge is emptied intermittently from the separation space by the sludge outlets 11 being opened, whereupon sludge and a certain amount of fluid is discharged from the separation space by means of centrifugal force. The discharge of sludge may also take place continuously, in which case the sludge outlets 11 take the form of open nozzles and a certain flow of sludge and/or heavy phase is discharged continuously by means of centrifugal force. Sludge which is discharged from the separation space via the sludge outlets is conveyed from the surrounding space 18 to the gathering vessel 23 connected thereto, in which the sludge accumulates and from which it is pumped out by the sludge pump 24.

Lower density components of the fluid, e.g. the light phase, or the pure fluid, without the heavier components, move radially inwards between the separation discs and out through the outlet 10. Friction effects due to the rotation of the rotor in the gas remaining in the space 18, the flow of the fluid through the separation space and losses in bearings cause the separated fluid at the outlet to be at a somewhat higher temperature than $T_0$. In order to affect the temperature of outgoing separated fluid, water is sprayed into heat-transferring contact with the rotor 2, e.g. towards its outer surface. Heat is removed from the rotor by the water vaporising upon contact with the rotor, thereby consuming vaporisation heat. The vaporisation of the water is further facilitated by the negative pressure maintained in the space.

Water vapour is removed from the space 18 round the rotor by the pump device 19, thereby maintaining said negative pressure. The vaporisation of the water followed by water vapour being conveyed away from the space results in a transfer of heat away from the rotor 2 and the space 18 to the pump device 19.

Another example of the centrifugal separator 1 according to the invention is depicted in FIG. 2, which differs from the above example as follows. An inlet 9 extends to the rotor 2 via a hollow, tubular spindle 3 for providing fluid to the separation space 7. The rotor has extending from it an outlet 25 for a lower density component, or light phase, separated from the fluid, and an outlet 26 for a higher density component, or heavy phase, separated from the fluid. The outlets 25 and 26 extend through the casing 15, and the space 18 is sealed by a seal 17. The rotor is provided with a sludge outlet 11 at an outer periphery for discharge of sludge phase to the space. The centrifugal separator is provided with a drive motor 12 comprising a stationary element 27 and a rotatable element 28, which rotatable element 28 surrounds and is so connected to the spindle 3 that during operation it transmits driving torque to the spindle and hence to the rotor 2. The drive motor is an electric motor, preferably of the hybrid permanent magnet motor (HPM motor) type. The centrifugal separator is further provided with a pump device 19 for removal of gas from the space 18 round the rotor, and with a device 20 for supply of a liquid to the space 18. This supply device is provided with a valve 21 for regulating a liquid flow to a nozzle 22 connected to said space 18. The centrifugal separator is further provided with a discharge device 24 in the form of a pump for removing sludge and other liquid from the space 18 round the rotor. The pump 24 is connected to a lower portion of the space 18 without any intermediate gathering vessel besides the pipe connections between the pump 24 and the space.

Figure 3:
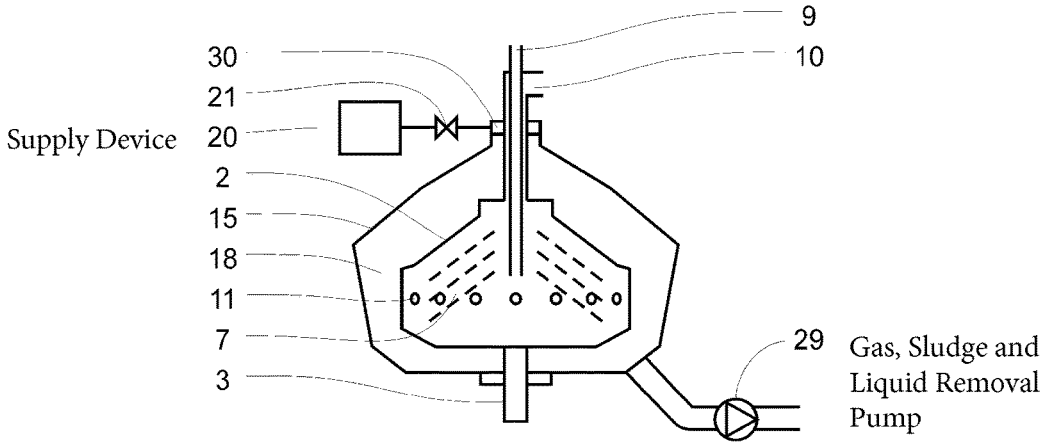
FIG. 3 depicts portions of a centrifugal separator according to a further embodiment of the invention.

A further example of portions of a centrifugal separator according to the invention is depicted in FIG. 3, which differs from the above examples as follows. The rotor 2 is supported by a spindle 3 which is solid. An inlet 9 in the form of a pipe extends into the rotor from above for providing fluid to the separation space 7. The rotor has extending from it an outlet 10 for discharge of at least one of the components of the fluid, which outlet surrounds the inlet pipe 9. The inlet 9 and the outlet 10 extend through the casing 15, and the space 18 round the rotor is sealed by a seal 30 round them. The rotor is provided with sludge outlets 11 at an outer periphery for discharge of sludge phase to the space. The centrifugal separator is provided with a device 20 for supply of coolant to the seal 30 for the latter's cooling, which coolant is thereafter brought into the space 18 and into contact with the rotor. The flow of coolant is regulated by the valve 21. The centrifugal separator is further provided with a pump 29 for removal of gas and liquid from the space, which pump maintains negative pressure in, and discharges sludge and other liquid from, the space 18.

Figure 4:
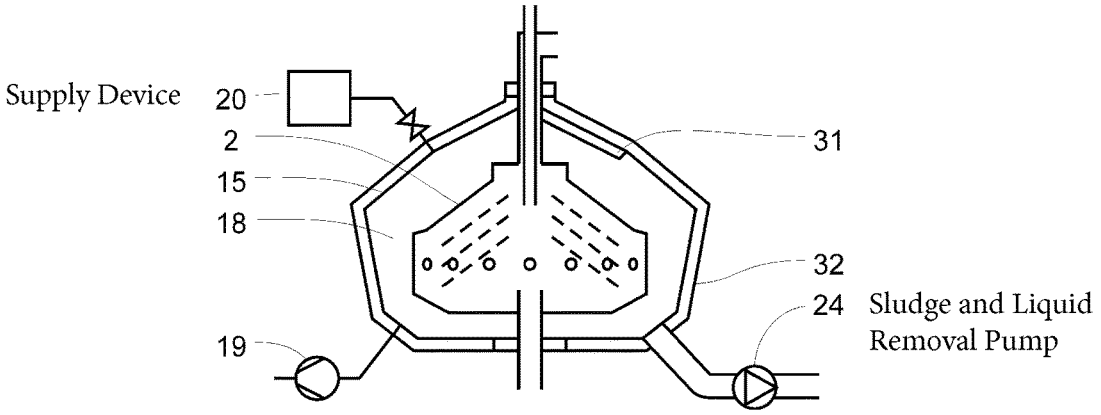
FIG. 4 depicts portions of a centrifugal separator according to a further embodiment of the invention.

A further example of portions of a centrifugal separator according to the invention is depicted in FIG. 4, which differs from the above examples as follows. The centrifugal separator is provided with a pump device 19 for removal of gas from the space 18, which space is surrounded by the casing 15 and contains the rotor 2. The separator is further provided with a device 20 for supply of a liquid to the space 18, and with a discharge device in the form of a pump 24 for removal of sludge and other liquid from the space 18 round the rotor. A region of the casing in the space 18, above the rotor 2, is provided with cooling, thereby forming a cold surface 31. The region is provided with one or more inclined surfaces so that vapour which condenses on the cold surface accumulates and drops or runs down onto the rotor by gravity. During operation, a certain amount of cooling medium is brought into the space and into contact with the rotor, which in the example is the warmest surface in the space, whereby at least part of the coolant vaporises. The vapour condenses against the cold surface 31 and accumulates before running back down onto the rotor in order to be vaporised again. The result is effective heat transfer between the rotor and the cold surface. The casing 15 is further provided with an outer shell 32 of thermally insulating and sound-insulating material, resulting in a further stable thermal environment in the space 18 and a good acoustic characteristic of the separator.

The invention claimed is:

1. A centrifugal separator comprising a casing which delimits a space which is sealed relative to the surroundings of the casing and in which a rotor is arranged for rotation, which rotor forms within itself a separation space, and in which separation space centrifugal separation of at least one higher density component and at least one lower density component from a fluid takes place during operation, into which rotor at least one inlet extends for introducing said fluid to the separation space, and from which rotor at least one first outlet extends for discharge of at least one component separated from the fluid during operation, where a pump device is in fluid communication with all of said space, the pump device being arranged to remove gas from the space during operation, thereby maintaining negative pressure in said space, and wherein the rotor comprises at least one second outlet extending from a portion of the separation space to the space for discharge of at least one higher density component separated from the fluid during operation;

the at least one second outlet being configured to at least partially seal the separation space from the space or selectively isolate the separation space from the spacer; and a discharge device in the form of a sludge pump being arranged to remove the at least one higher density component separated from the fluid from the space during operation.

2. A centrifugal separator according to claim 1, wherein second outlet is arranged for intermittent discharge of at least one higher density component separated from the fluid during operation.

3. A centrifugal separator according to claim 1, wherein second outlet is arranged for continuous discharge of at least one higher density component separated from the fluid during operation.

4. A centrifugal separator according to claim 1, further comprising an inlet line for supplying a medium to the space, which medium is brought into heat-transferring contact with the rotor in order to regulate the temperature of the rotor.

5. A centrifugal separator according to claim 4, wherein said medium comprises a liquid which in said heat-transferring contact is at least partly caused to evaporate and form a gas medium in the space.

6. A centrifugal separator according to claim 4, wherein said medium comprises a gas medium.

7. A centrifugal separator according to claim 5, wherein said gas medium has a density lower than the density of air and/or a viscosity lower than the viscosity of air.

8. A centrifugal separator according to claim 4, wherein said medium is sprayed towards the rotor.

9. A centrifugal separator according to claim 4, wherein said medium is finely divided in the space.

10. A centrifugal separator according to claim 4, wherein a flow of medium into the space is driven by pressure difference between a container for medium and the space and is controlled by a valve.

11. A centrifugal separator according to claim 5, further comprising a cold surface in the space for condensation of said gas medium to a condensate.

12. A centrifugal separator according to claim 11, wherein the condensate is brought into heat-transferring contact with the rotor in order to regulate the temperature of the rotor.

13. A centrifugal separator according to claim 1, wherein the casing comprises thermally insulating and/or sound-insulating material.

14. A centrifugal separator according to claim 1, wherein the space is sealed or isolated from an inlet chamber in the rotor or an outlet chamber in the rotor or both the inlet chamber and outlet chamber.

15. A centrifugal separator according to claim 1, wherein the space is sealed relative to a drive device which is arranged to provide torque to the rotor.

16. A centrifugal separator according to claim 1, wherein a discharge device is arranged to remove at least one component separated from the fluid during operation from the space.

17. A centrifugal separator according to claim 16, further comprising a vessel between the space and the discharge device for gathering at least one component separated from the fluid.

18. A method for operating a centrifugal separator, the method comprising:

providing a centrifugal separator comprising a casing which delimits a space which is sealed relative to the surroundings of the casing and in which a rotor is arranged for rotation, said rotor forming within itself a separation space, at least one inlet extending into said rotor, and at least one first outlet extending from said rotor, a pump device is in fluid communication with all of said space, the rotor comprises at least one second outlet extending from a portion of the separation space to the space, the at least one second outlet being configured to at least partially seal the separation space from the space or selectively isolate the separation space from the space;

removing gas from the space round the rotor, thereby maintaining negative pressure in said space;

discharging from a portion of the separation space to the space via said second outlet at least one higher density component separated from the fluid during operation; and removing the at least one higher density component separated from the fluid from the space during separation via a discharge device in the form of a sludge pump.

19. A method according to claim 18, which further comprises the steps of:

supplying a medium to said space, which medium is brought into heat-transferring contact with the rotor in order to regulate the temperature of the rotor.

20. A method according to claim 19, in which said medium comprises a liquid which in said heat-transferring contact with the rotor is at least partly caused to evaporate and form a gas medium in the space, and in which at least part of said gas medium is removed from the space.

* * * * *